United States Patent [19]

Zannini

[11] Patent Number: 4,855,031

[45] Date of Patent: Aug. 8, 1989

[54] EQUIPMENT FOR THE MECHANIZED REPLACEMENT OF THE ANODES IN THE ELECTROLYTIC CELLS FOR ALUMINUM PRODUCTION

[75] Inventor: Gianfranco Zannini, Limena, Italy

[73] Assignee: Techmo Car S.p.A., Limena, Italy

[21] Appl. No.: 175,186

[22] Filed: Mar. 30, 1988

[30] Foreign Application Priority Data

Jul. 9, 1987 [IT] Italy ..... 21231 A/87

[51] Int. Cl.[4] ..... C25C 3/10; C25C 3/14

[52] U.S. Cl. ..... 204/225; 204/245

[58] Field of Search ..... 204/67, 243 R–247

[56] References Cited

U.S. PATENT DOCUMENTS

| | | | |
|---|---|---|---|
| 3,769,195 | 10/1973 | Weterings | 204/245 X |
| 4,053,384 | 10/1977 | Siegmund | 204/245 X |
| 4,119,505 | 10/1978 | Baillot et al. | 204/245 X |
| 4,701,249 | 10/1987 | Wisniewski et al. | 204/245 X |

*Primary Examiner*—Donald R. Valentine

*Attorney, Agent, or Firm*—Collard, Roe & Galgano

[57] ABSTRACT

Module for mechanized replacement of the anodes of electrolytic cells for the production of primary aluminum, constituted by a cage-shaped structure which can be hooked to a usual bridge crane, with said structure a control cab (8), a hopper, fork-shaped positioning elements, a telescopic arm (17) for clamping, unscrewing and locking anode bars, a crust-breaker device (11), a device for cleaning the upper surface of the worn anode and a skimmer device (14) being associated.

8 Claims, 7 Drawing Sheets

EQUIPMENT FOR THE MECHANIZED REPLACEMENT OF THE ANODES IN THE ELECTROLYTIC CELLS FOR ALUMINUM PRODUCTION

DESCRIPTION

The present invention relates to an equipment, suitable for being stably hooked to a bridge crane, capable of making it possible the rapid replacement of the anodes of the cells for the electrolytic production of aluminum to be carried out by means of a mechanized procedure, with the perfect repositioning of the new anodes.

It is known that the cells or furnaces for the electrolytic production of primary aluminum with pre-baked anodes are equipped with a collector plate, constituting the cathode, placed on the bottom of the cell, made of coal, graphite, or the like, connected to a d.c. generator, whilst the anode is constituted by a set of blocks of a carbon-based material, provided with "shafts" or "stems" connected, with the possibility of removal, with a bus-bar (the anodic bar). The set of blocks—or anodes—of each cell is dipped in the molten mass of the bath at a constant distance from the cathodic plate.

As—as also is known—the anodes wear out as a function of the produced amount of aluminum, their frequent replacement is necessary, and such a replacement requires that the basis of each new anode comes to be, after the removal of the worn anode, at the same distance from the cathodic plate as the worn anode had, i.e., each new anode must always be on the same plane, and at the same level as of the worn anode previously removed.

At present, in order to replace the anodes, self-propelled trucks with lifting cranes are used, which usually operate along the aisle of the furnaces arranged lengthwise, i.e., in an "end-to-end" position, or purposely equipped bridge cranes are used, which run above the set of the furnaces arranged crosswise, i.e., in a "side-to-side" position. Both the self-propelled trucks and the equipped bridges cranes make it possible the replacement of one single anode at a time to be carried out, and have, in any case, a large weight, and a massive and cumbersome structure, in that they must withstand the axial stresses and strains due to the weight of the anode, and to the "jerk" which has to be applied to the anode shaft in order to extract the same anode from the solidified crust surrounding it; in case of self-propelled trucks, the weight of the anode and the direction of the jerk, by being shifted relatively to the barycentre of the truck, create serious problems of stability for the same truck.

On the contrary, in case of use of bridge cranes these latter must be equipped with devices suitable for performing the jerk, and shifting the anode from the extraction position to the unloading position. Furthermore, both the use of self-propelled trucks or cranes, and the use of equipped bridge cranes according to the prior art, requires always a full set of surveys and measurements to be carried out, which are delicate and exacting, in order to position the new anodes with their base surface being exactly at the same distance from the cathodic plate, and on the same plane as of the removed anode.

Finally, the bridge cranes purposely equipped for replacing the anodes, in case of failures, must be repaired on the spot, and this necessarily causes an interruption of the operations throughout the repair time.

The self-propelled crane trucks and the purposely equipped bridge cranes have then a poor flexibility, and show a low operating speed.

A purpose of the present invention is to provide an equipment which is capable of performing, in a simple, rapid and reliable way, the mechanized replacement of the anodes of cells for the electrolytic production of primary aluminum, without requiring the usual delicate operations of pre-measurement of the new anode with reference to the worn anode, in order to be able to correctly position the same anode after removing the worn anode, and without requiring the use of a particularly specialized staff.

Another purpose of the invention is to provide an equipment of the above specified type, having such a structure as to result compact, which can be easily hooked to the car of a traditional bridge crane and having, incorporated in itself, the necessary devices for carrying out, by a mechanical procedure, and in a pre-established sequence, all the operations which are required in order to remove a worn anode, and subsequently position the new anode in a correct way.

Not least purpose is to provide an anode-replacement equipment which is highly reliable, easily and rapidly replaceable in case of failures, and equipped with means for performing a plurality of functions, such to allow it to be used as an automated polyfunctional module, and which can be adopted and used also on already existing and differently equipped facilities, by means of simple and easy adaptations of the bridge cranes provided for normal operations.

These, and still further purposes, which can be more clearly evidenced from the following disclosure, are achieved by means of an equipment or module for the mechanized replacement of the anodes of electrolytic cells for the production of primary aluminum, which equipment is constituted, according to the present invention, by a load-bearing structure having a substantially cage shape, open at the bottom, and which can be hooked, at the top, in a stable way, with the possibility of disengagement, to the crane of a car associated with a bridge crane of the already provided type, normally existing in the pot rooms, and running crosswise to the direction of running of the same bride crane, wherein said cage-shaped structure comprises:

- two horizontal, flat beds protruding in mutually opposite positions, outside the open basis of the module, wherein on each of said protruding flat beds at least one sliding saddle is mounted, which is capable of alternatively translating in such a way as to come to protrude inside the interior of said open basis of the module, and designed to support at least one new anode and at least one worn anode,
- a control cab for an attending operator associated with said cage and outside it, and, in a symmetrically opposite position, a hopper suitable for containing a covering material, such as alumina and/or ground electrolysis bath, to be discharged above the new anode as soon as this latter is positioned inside the furnace,
- at least one retractible positioning element having a fork shape, or a similar shape, laterally protruding from said cage, and provided with means enabling it to be anchored to the anodic bus-bar with lateral reference relatively to the anode shaft of an adjacent anode, in order to make it possible the module to be correctly positioned before the furnace, so as to enable the worn anode to be removed, and the new anode to be positioned, with the said module being maintained in its position, a car sliding on horizontal guides protruding from the top of the cage structure, in a direction perpendicular to the direction of translation of said anode-holder saddles, and equipped with an arm which can be telescopically extended in the vertical direction, supporting known means for unlocking and locking the shaft of an anode from/to said anodic busbar, as well as suitable means for clamping and lifting the same anode, with said car being translatable, so as to transfer the worn anode back into a central position inside the cage and then to transfer it to a saddle protruding from a flat bed, and then translated on the same flat bet, and to subsequently transfer a new anode, with a reverse procedure, to the same exact position in which the worn anode was, with said cage a crust-breaker device of known beating type, supported by a retractible telescopic rod; a telescopically adjustable device for cleaning the upper surface of the worn anode; as well as an also retractible skimmer device, suitable for enabling the operator to carry out the cleaning of the hollow space left free by the worn anode, before the positioning of the new anode, being finally associated.

More particularly, said module for anode replacement can be hooked to the crane of said car associated with the bridge crane by means of telescopic guide means equipped with means for stably locking the same module to the bottom matching plane of the same car, in order to prevent the same module from laterally oscillating during its shifts, and during the operating steps of anode-replacement procedure; furthermore, at the basis of said module, retractible legs are provided, which are suitable for stabilizing the module when it is in its operating position.

Further structural and functional characteristics of the invention are brought forth by the following disclosure in detail thereof, which is made by referring to the hereto attached drawing tables, which are given for only indicative and non-limitative purposes, wherein:

Figure 3:
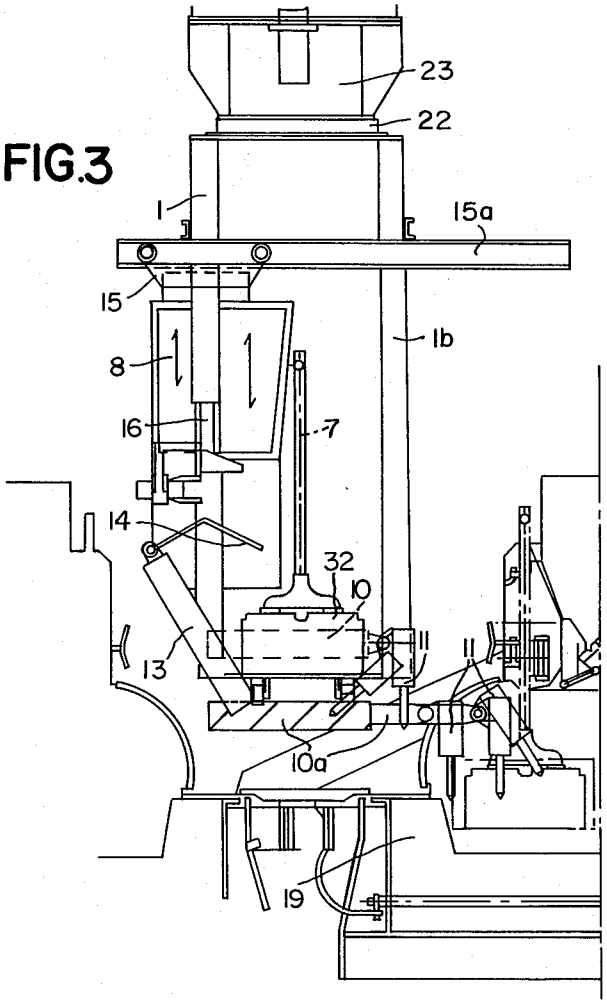
FIG. 3 shows the positioning of the module of FIGS. 1 and 2 near the furnace, with the crust breaker being in its operating position.

Referring to such Figures, the equipment for anode replacement of the present finding is substantially configurable as a poly-functional module; said module is constituted by a cage structure formed by four vertical uprights 1, 1*a*, 1*b* (the fourth upright is hidden in the Figures), stiffened at their upper side by horizontal crosspiece 2, such as to form a box-like body having open side walls and floor. At the basis of the couples of uprights 1–1*b* and 1*a*–1*c* (this latter is hidden in the Figures) two flat beds 3 and respectively 3a are provided, which are coplanar and symmetrically positioned relatively to the centre axis of the cage structure. On each of said flat beds 3, 3*a* a saddle 4, and respectively 4*a*, is located, which can be translated up to come to protrude inside the central portion of the cage structure, as shown in short-dash lines, and indicated by the reference numeral 4*b*, in FIG. 1.

Figure 7:
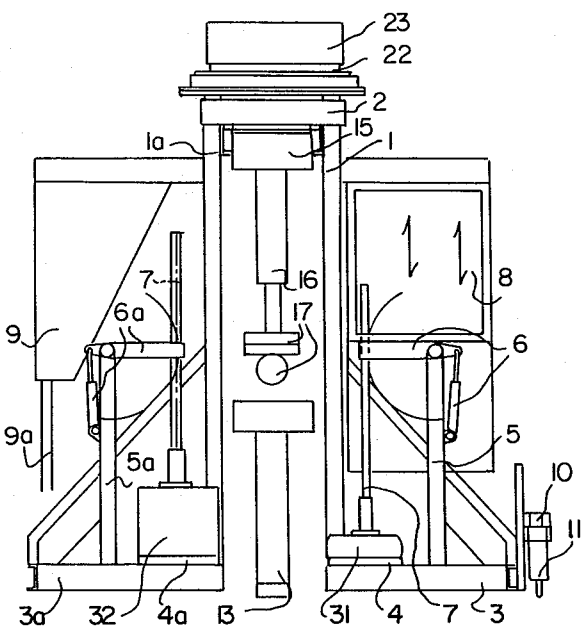
FIG. 7 shows a front view of the module with the worn anode and with the new anode in their retracted position on their respective flat beds.

Said saddles are destined to support, and translate to/from the central region of the cage structure a new anode and a worn anode, as is better clarified in the following. With each saddle 4, 4*a*, a vertical beam 5 and respectively 5*a* is associated, at whose top orientatable locking means 6 and 6*a* of known type are provided, which are suitable for locking and retaining the shaft 7 of the anodes, as shown in FIG. 7.

Laterally to the uprights forming the cage, and offset relatively to the translatable saddles 4, 4*a*, a control cab 8 for an operator and, on the opposite side, a hopper 9 containing alumina, or crushed bath, for covering the new anode, after its positioning, by means of an orientatable feed duct 9*a*, are associated.

Frontally to the flat bed 3, a telescopic arm 10 is installed, which supports a crust breaker 11 of beating type, known from the prior art; said arm is anchored to the flat bed in such a way as to be able to be moved from a resting position 10 (FIG. 3) to an operating position 10*a*, and its function is better explained in the following. To the bottom inner portion of the cage structure, another telescopically extendible arm 13 is hinged in 12 (FIG. 2), with said arm 13 bearing a revolving skimmer fork or blade 14, also of a type known from the prior art, which is suitable for cleaning the empty room left in the crust of the bath by the worn anode after its removal (FIG. 9).

Figure 1:
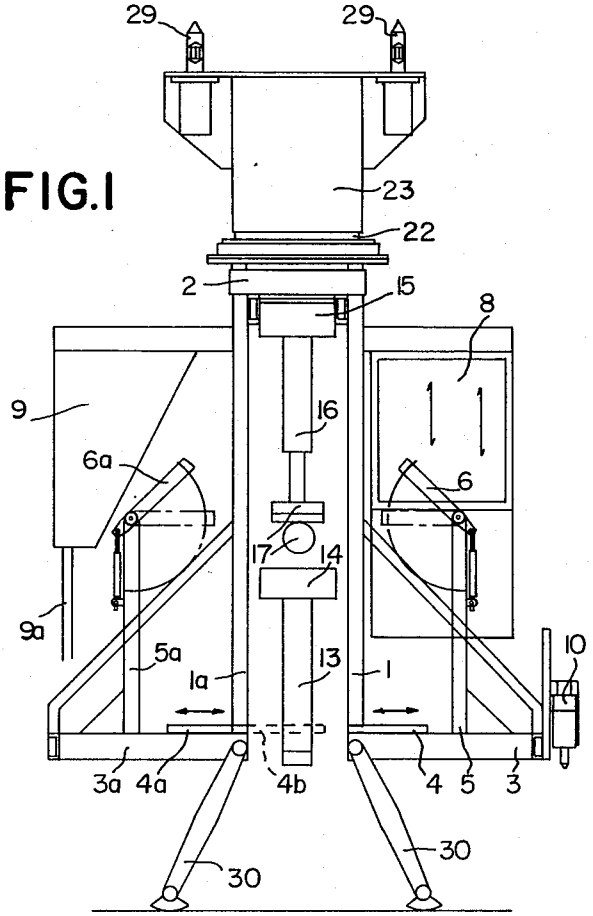
FIG. 1 is a diagram showing the front view of an equipment or module, accomplished according to the invention, and depicted in its resting position.
Figure 2:
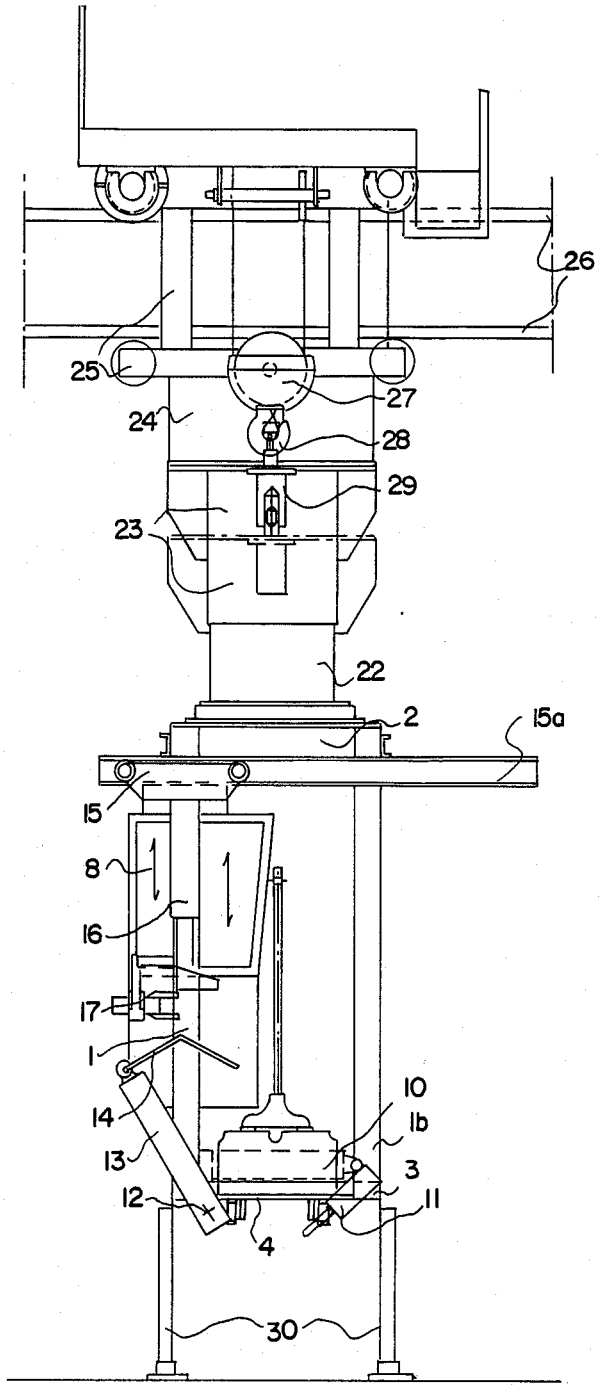
FIG. 2 shows a side view of the module of FIG. 1, hooked to a car integral with a traditional bridge crane and with a new anode on board.
Figure 5:
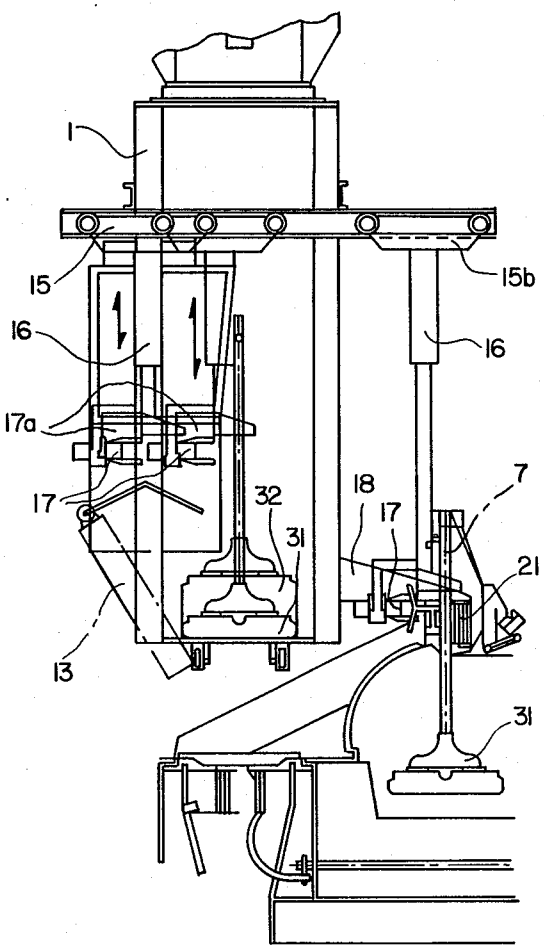
FIG. 5 shows the same module while the step of clamping, unscrewing and lifting of the worn anode, and of final positioning of the same anode inside the module is performed.
Figure 9:
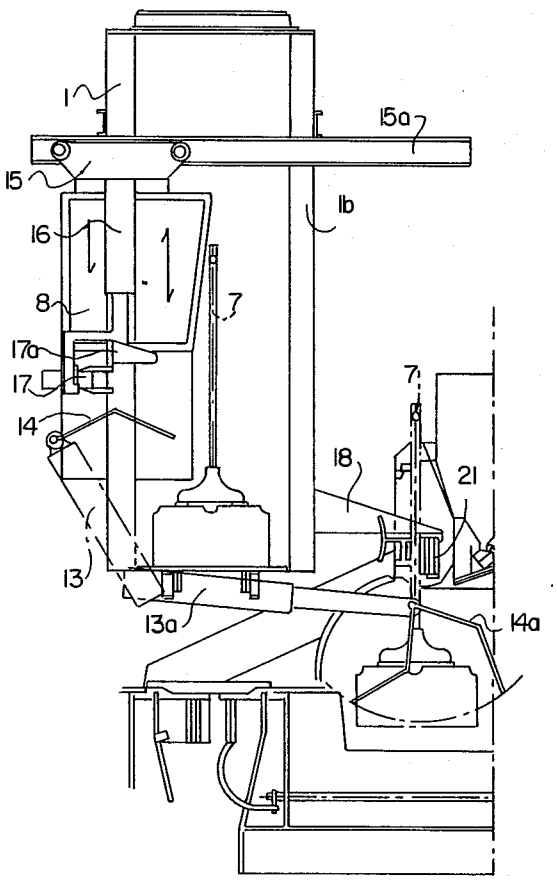
FIG. 9 shows the revolving-fork cleaning means, for cleaning the hollow space left free by the worn anode.
Figure 10:
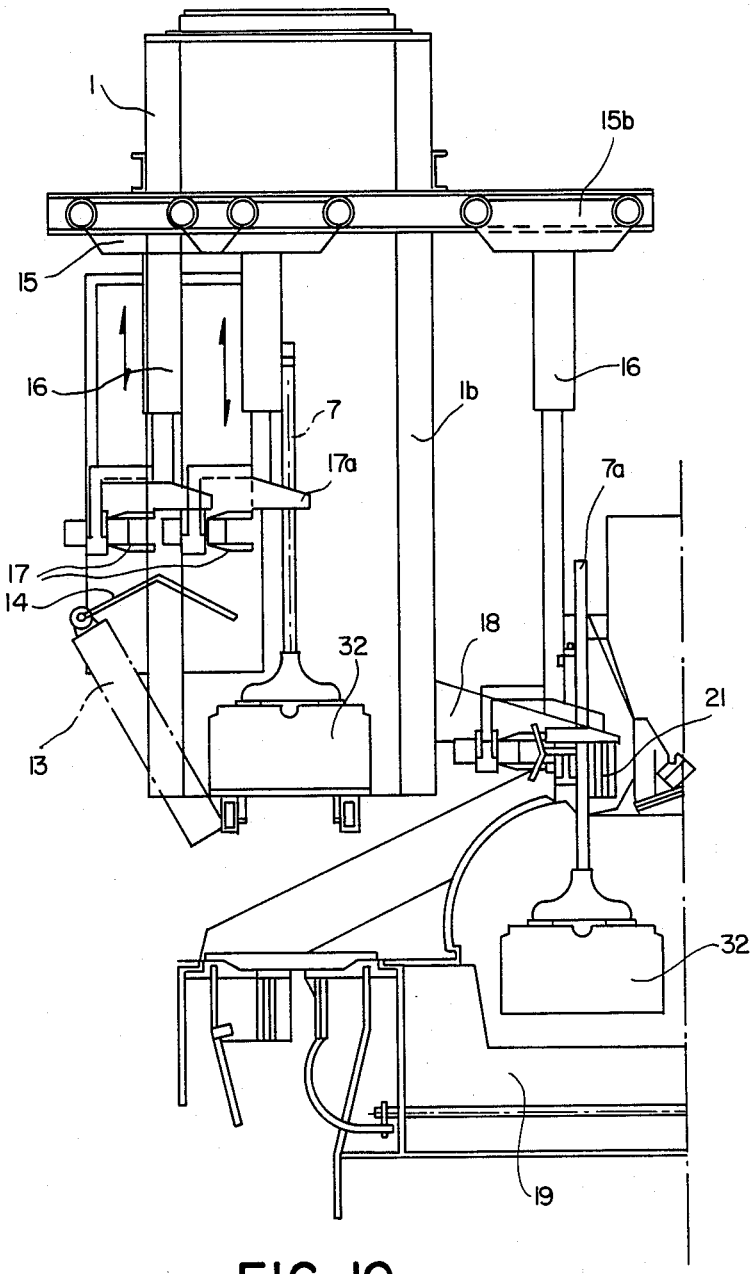
FIG. 10 shows the means for translating the new anode from its clamping position inside the module, and the transfer thereof to the cell, with its anchoring to the anodic bus-bar.

When resting, the arm 13 of the skimmer 14 is retracted and stopped in the position shown in FIGS. 1 and 2, whilst, when operating, it is brought to the position 13*a*–14*a* of FIG. 9.

Still in the lower portion of the cage structure, a telescopic-arm device 33 (FIG. 8) is provided, which is extendible parallelly to the telescopic arm 10*a* of the crust breaker. At the free end of said telescopic arm 33, a scraper, or blade, 34 is anchored. This device is used in order to clear the upper surface of the worn anode of the residues of crust, making them fall down into the same cell and thus getting rid of most of the burdensome operations of handling of bath residues to be recovered.

Furthermore, according to the present invention, the advantage is achieved that the solidified bath is added again to the same cell it comes from, thus preventing that any alterations may occur in the composition of the same bath, when special additives, such as lithium, magnesium, and the like, are used.

Inside the upper inner portion of the cage structure a motor-driven car 15 is provided, which can run along guide rails 15*a* protruding outside the cage structure, to a direction perpendicular to the direction of translation of the anode-bearing saddles 4, 4a. With said car 15 an arm 16 is associated, which is telescopically extendible and adjustable. With the lower end of said arm 16, a device is associated, for clamping, unscrewing and lifting the anode shaft 7 for removing it from the anodic bus-bar 21. Such a device is of a type known from the prior art, and is generally indicated by the reference number 17 in the Figures. Said clamping and lifting device 17 starts operating when the module is positioned side-by-side to the furnace in a position which is well defined and stably maintained, in order to slip the worn anode off the bath by levering, through the thrust block 17*a*, on the anodic bus-bar, transfer said worn anode to the module and bring the new anode from the module to the exact position left free by the worn anode.

The final positioning of the module relatively to the furnace 19 is obtained by means of two hydraulic-controlled positioning forks 18 (FIGS. 4, 5, 9 and 10), orientatable by being rotatable around a hinge 20 provided on an upright of the module, and whose free ends are moved—by shifting the module in height, lengthwise and perpendicularly to the same furnace, as is better clarified in the following—to an anchoring position on the anodic bus-bar 21 and on the anodic bus-bar of an adjacent anode.

The height of positioning of the module is thus defined by anchoring a fork member on the bar 21, and the lateral positioning—i.e., relatively to an adjacent anode—thereof is defined by means of a fork-shaped spacer member placed in contact with the shaft of said adjacent anode.

After the final positioning of the module, the car 15 with the anode unscrewing, extracting and lifting unit can carry out the cycle of removal of the worn anode and of positioning of the new anode in the exact position left free by the worn anode.

The module having the above disclosed structure, and equipped with the anode-replacement and auxiliary devices as above disclosed, is provided with means enabling it to be hooked, according to the present invention, to an usual bridge crane generally already available inside the cell rooms. For that purpose, with the upper crosspieces 2 of the vertical-upright cage structure, a cylindrical body 22 is associated (FIG. 2), which can slide, in a telescopic fashion, inside the body of a cylindrical guide 23, which is provided with an upper flat surface for matching with a body 24 integral with a car 25 sliding on rails 26; the rails 26 are integral with the basis of a traditional bridge crane (not shown in the Figures) and are positioned perpendicularly to the direction of running of the same bridge crane. With the car 25, a crane 27 is integral, to whose hook 28 the upper end of said body 22 integral with the module is anchored.

In order to give the module stability against side oscillations during the bridge crane translation movements, on the body 23 four peripheral studs 29 are provided, which can enter the body 24 integral with the car 25. Therefore, by actuating the crane 27, the body 22 slides in a telescopic fashion inside the body 23 coupled with the basis of the car 25, and the module can be therefore lifted or sunk to the required levels during the transportation of the module for anode charging-discharging operations, and for it to be positioned during the step of worn anode replacement by the new anodes.

Therefore, the module can perform three kinds of movement in space: an up-and-down movement in the vertical direction allowed by the crane 27 of the car 25, a movement in the longitudinal direction, and parallel to the anodes of the cells by means of the brodge crane, and a movement perpendicular to the side-by-side anodes, by means of the car 26 integral with the bridge crane, and translatable perpendicularly to the direction of movement of the same bridge crane.

The system of guide-hooking the module to the car of the bridge crane also compensates for any possible mistakes in alignment. The telescopic system contains then the system for turning the module through 180°, so that the same module can operate on both furnace sides. Furthermore, a purposely provided safety system, of known type, makes it possible the module turning manoeuvres to be only carried out inside the side aisles, and above no-collision conditions.

The above disclosed module may be completed with two support legs 30 of folding or retractible type, or the like, (FIGS. 1–2), which can be lowered down when the module is positioned, in order to stabilize it during the operating steps.

The use of the module, and the operation, according to the pre-established sequence, of its anode-replacement devices are disclosed in the following, with particular reference to FIGS. from 3 to 11, as referred to the replacement of an exhausted, or worn, anode 31 by a new anode 32.

The bridge crane is initially positioned on the module, and the power feed cable (not shown) necessary for actuating the various devices associated with the module is connected; the new anode 32 is assumed to be already on board of the module, on the side saddle 4*a*, with the anode shaft being locked by the device 6*a*. The module is hooked to the car 25, and is lifted, with the body 23 being approached to the plane of the body 24 integral with the car 25. During this step, the support legs 30 are retracted, or folded, inside the module.

Figure 4:
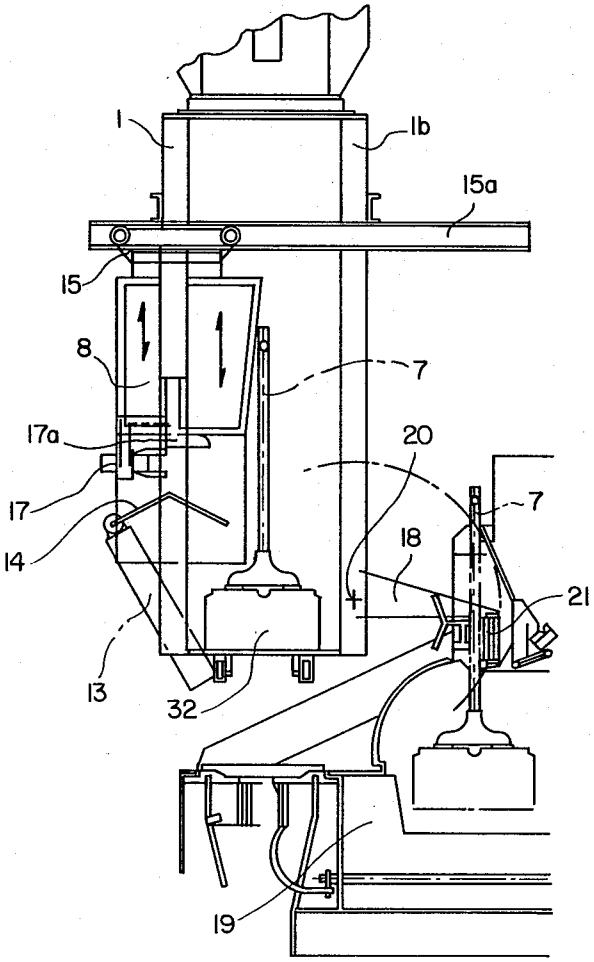
FIG. 4 shows the final positioning of the module, with the positioning fork-shaped member being hooked to the anodic bus-bar.

Then, by acting on the bridge crane and on the car 25 associated with it, the module is positioned near the furnace, with the rails 15*a* of the car 15 being directed perpendicularly to the anode row (FIG. 3). The operator on board of the control cab 8 causes the crust-breaker bearing arm to move downwards from its resting position 10 to its operating position 10*a* (FIG. 3) and then, by suitably varying the telescopic extension of the arm 10, the crust breaker tool 11 is led to the opposite transversal edges of the worn anode to be removed (not shown), and the breakage of the crust along the same edges is caused; then, by displacing the bridge crane and the module, the crust breaker tool 11 is brought before the anode 31, thus breaking the crust along the outer front edge of the same anode. The module is subsequently brought to its final position relatively to the furnace (FIG. 4). Such a position is defined by lowering the positioning-reference fork member 18 on the anodic bus-bar 21, and anchoring it to the same bus-bar; the precise reference is supplied by the position of the shaft of an anode adjacent to the exhausted anode, on which a second fork member is anchored, by the height of the bus-bar 21, and by the fixed distance of the module from the same bus-bar 21. The car 15 is then translated from its resting position to its external position 15*b* (FIG. 5), then its telescopic arm 16 is sunk, bringing to its operating position the unit 17 provided with the clamping and unscrewing means for engaging and unscrewing the fastener locking the anode shaft 7 (FIG. 5), with the thrust block means 17*a* acting on the anodic bus-bar, and with the anode lifting means.

The positioning of the unit 17 takes place automatically due to the effect of the reference created by the fork member 18 in engagement with the anodic bus-bar 21.

The clamp means engages the side of the anode shaft at the height of the anode crosspiece, and the unscrewing means unscrews the fastener and holds said fastener.

When the anode shaft is disengaged from the locking fastener, with said anode shaft being hold by the same arm 16, by means of a jerking action (better known as "pumping action"), the detachment of the worn anode 31 from the bath is caused, by levering on the thrust block 17*a* associated with the tool 17. The same equipment holds the shaft 17 of the anode 31, and by lifting the arm 16 and by returning the car 15 from its position 15*b* back to its stop position inside the module, the anode 31 is transferred to the mouth of the opening between the two flat beds 3 and 3*a*, and is stopped inside the interior of the module wherein the saddle 4, by moving from its respective flat bed to an overhanging position, receives the worn anode 31.

Figure 6:
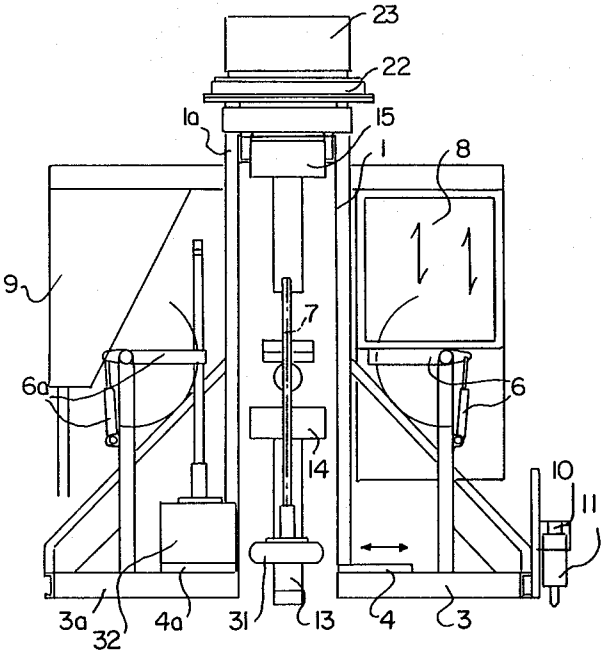
FIG. 6 shows the means for supporting the worn anode after that said worn anode is transferred to the retracted-anode position in the centre of the module.

In FIG. 6, the anode 31 is shown inside the module, and in FIG. 7, the anode is shown as positioned on the respective saddle in its retracted position, wherein its shaft 7 is locked by the device 6.

After the detachment of the worn anode from the bath, and before the same anode is lifted by the arm 16, the cleaning device for cleaning the upper surface of the same anode starts operating.

Figure 8:
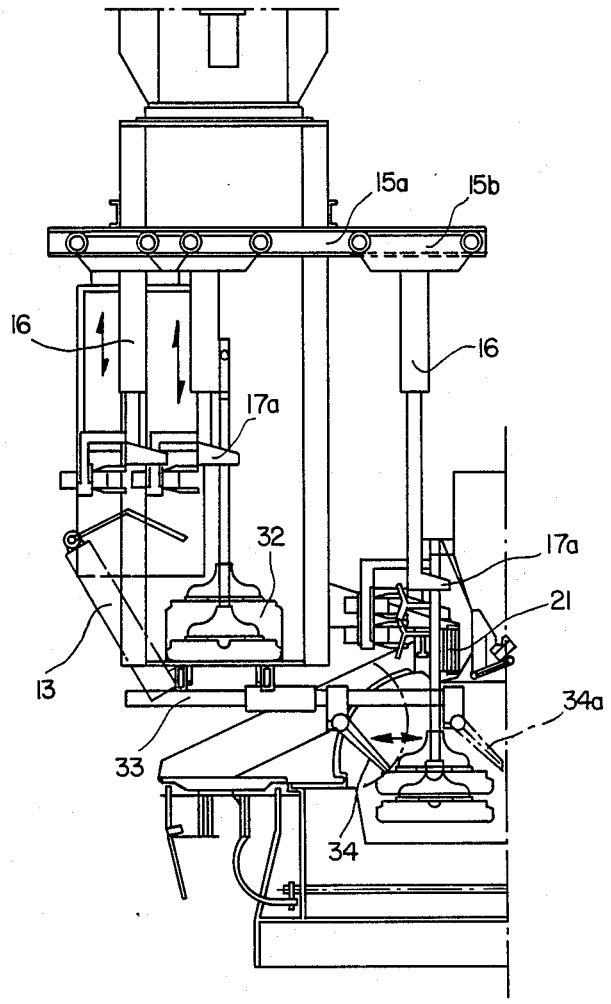
FIG. 8 shows the scraper means for cleaning the upper surface of the worn anode before this latter is removed.

Such a device, by means of the telescopic arm 33, moves forward the scraper 34, into contact with the anode, until it reaches the position 34*a* (FIG. 8). Once that the exhausted anode is removed, the skimmer device 13 equipped with the fork or blade member 14, adjustable in position by means of its telescopic arm, starts operating and carries out the cleaning of the empty space left free by the worn anode and, when the cleaning is complete, is brought back to its resting position 13 (FIG. 9).

The new anode 32 is translated by its saddle 4*a* to the centre of the module, in its suitable position for being taken by the arm 16 of the upper car 15 at the same height, relatively to the reference plane, as of the exhausted anode; the arm 16 places the new anode 32 inside the empty space inside the bath, and then screws down again the fastener which fastens the anode shaft 7*a* to the anodic bus-bar 21. Thus, carrying out the delicate and exacting operation of "pre-measurement" is no longer required.

Figure 11:
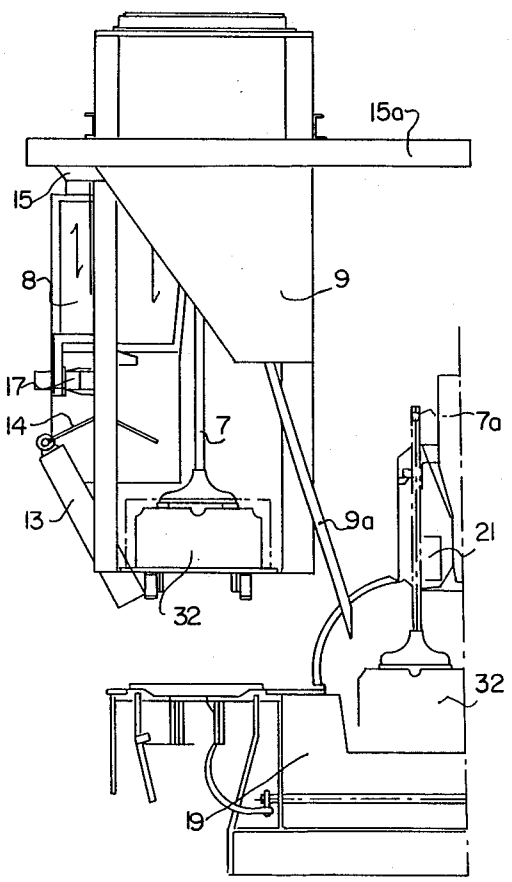
FIG. 11 shows the hopper, in its operating position, for covering the new anode with alumina, or the like, before the worn anode is definitely transferred away from the cell.

When the new anode is placed in its end position (FIG. 10), the hopper 9 (FIG. 11) starts operating, which, by means of its duct 9*a* performs the covering of the new, positioned, anode 32. The module is then transferred by the bridge crane to the place wherein the worn anode has to be discharged, and a new anode has to be charged on board.

When resting, the module is normally positioned on a trailer, or also on a self-propelled truck, of a known type, not shown in the Figures. Furthermore, the above disclosed module may be provided with two couples of anode-holder saddles 4–4*a*, so as to have available on board of the module two new anodes to be placed in position, and make it possible two worn anodes to be extracted from the furnace, with a consequent considerable reduction in the various operations of handling and transportation through the pot room.

Obviously, when the invention as above disclosed is practiced, structurally and functionally equivalent modifications and variants may be supplied, without departing from the scope of protection thereof.

I claim:

1. Equipment for the mechanical replacement in an anodic bus-bar of the anodes of electrolytic cells in a furnace for the production of primary aluminum, said furnace being in a cell room having a bridge crane therein, said equipment comprising:

(a) a first car associated with the bridge crane and adapted to move transverse to the movement of the bridge crane, said car having a crane associated therewith;

(b) a substantially cage-shaped polyfunctional load bearing module, open at the bottom and adapted to be detachably hooked at its top to the crane of said first car;

(c) two horizontal flat beds carried by said cage structure oppositely disposed from the open central region thereof;

(d) a saddle mounted on each of said beds, each of said saddles being adapted for translational movement to and from the open central region of the cage structure, one of said saddles adapted to support a new anode and the other a worn anode;

(e) a control cab for an operator arranged on the outside of said cage structure;

(f) a hopper for a covering material, such as alumina or ground electrolysis bath, to be discharged above the new anode when it is positioned inside the furnace, said hopper being symmetrically oppositely arranged on said cage structure from said control cab;

(g) at least one fork-shaped retractable positioning element protruding laterally from said cage having means for anchoring to the anodic bus-bar with lateral reference to the anode shaft of an adjacent anode so as to position the module with respect to the furnace for removal of the worn anode and replacement with the new anode;

(h) a second car slidingly guided horizontally from the top of said cage structure transversely to the movement of said saddles;

(i) a vertically extending telescoping arm carried by said second car having means for locking and unlocking the shaft of an anode and for clamping and lifting said anode, so that a worn anode can be transferred from the anodic bus-bar to the appropriate saddle disposed in the central region of the cage structure by said second car which is then transferred by the translation of the saddle to the appropriate flat bed and by reverse procedure a new anode is transferred from the opposing flat bed to the vacated anodic bus-bar;

(j) a beating type crust breaker device supported by a retractable telescopic rod and associated with said cage structure;

(k) a telescopically adjustable device associated with said cage structure for cleaning the upper surface of the worn anode; and (l) a retractable skimming device associated with said cage structure for cleaning the furnace from whence a worn anode is removed.

2. The equipment as defined in claim 1, which further comprises telescopic guide means having means for stably fastening said module to a lower matching plate of said first car, so as to prevent oscillations during the travelling of the bridge crane and during the operating steps of anode replacement.

3. The equipment as defined in claim 1, which further comprises a clamping and retainer device associated with each of said saddles for clamping and retaining the anode, said device acting on the shaft of the anode.

4. The equipment as defined in claim 1, wherein said positioning element positions said module relative to the furnace based on a reference taking into account the axis of the anode adjacent to the worn anode, the height of the anodic bus-bar, and the fixed distance of the module from the bus-bar, so that the burdensome and delicate operations of pre-measurement for the new anode are not required.

5. The equipment as defined in claim 1, which further comprises retractable or folding legs in the lower end of said module for stabilizing the module when positioned for operation.

6. The equipment as defined in claim 1, which further includes a trailer or a self-propelled truck so as to support and move the module outside the operating and/or resting steps.

7. The equipment as defined in claim 1, which further comprises in association with each of said flat beds outwardly protruding from the central region of said cage structure a plurality of translatable saddles positioned side-by-side to each other and independent from each other, suitable for supporting a plurality of new anodes and a plurality of worn anodes; respectively.

8. The equipment as defined in claim 1, which is adaptable to be hooked to normal bridge cranes already existing in a cell room.

* * * * *